US007121629B2

(12) United States Patent
Chou

(10) Patent No.: US 7,121,629 B2
(45) Date of Patent: Oct. 17, 2006

(54) HEALTHY CHAIR

(76) Inventor: Shang-Wei Chou, 5F,No.1,Lane 9, SEC. 6, Chung-Hsiao E. Road, Taipei (TW)

( * ) Notice: Subject to any disclaimer, the term of this patent is extended or adjusted under 35 U.S.C. 154(b) by 0 days.

(21) Appl. No.: 10/828,851

(22) Filed: Apr. 19, 2004

(65) Prior Publication Data

US 2005/0242653 A1 Nov. 3, 2005

(51) Int. Cl.
*A47C 31/00* (2006.01)

(52) U.S. Cl. ..... 297/487; 297/423.11; 297/195.11

(58) Field of Classification Search ..... 297/487, 297/423.11, 488, 195.11, 195.1, 423.1, 423.12
See application file for complete search history.

(56) References Cited

U.S. PATENT DOCUMENTS 3,754,787 A * 8/1973 Garber ..... 297/487
4,607,882 A * 8/1986 Opsvik ..... 297/452.23
4,650,249 A * 3/1987 Serber ..... 297/423.11
4,662,361 A * 5/1987 Patterson ..... 297/391
4,699,423 A * 10/1987 Fitzig et al. ..... 297/245
4,832,407 A * 5/1989 Serber ..... 297/423.12
5,295,728 A * 3/1994 Schaevitz ..... 297/195.1
5,490,716 A * 2/1996 Naughton ..... 297/488
5,542,746 A * 8/1996 Bujaryn ..... 297/488
5,634,687 A * 6/1997 Gamble ..... 297/487
5,971,485 A * 10/1999 Clark ..... 297/408
6,565,154 B1 * 5/2003 Davis ..... 297/487
6,619,747 B1 * 9/2003 Ko et al. ..... 297/423.12
6,959,962 B1 * 11/2005 Dixon ..... 297/195.11

* cited by examiner

*Primary Examiner*—Laurie K. Cranmer
(74) *Attorney, Agent, or Firm*—Pro-Techtor Int'l Services

(57) ABSTRACT

A healthy chair comprises an inclined seat plate, a plurality of feet, and a frontal torso positioning device. The seat plate has a front side and a rear side that is higher than the front side. The frontal torso positioning device is fastened to the seat plate at the rear side thereof and extends forward and upward. Support bars for resting the feet of a user are positioned near the feet of the chair below the rear side of the seat plate. Thereby an upright sitting position is automatically assumed by the user, with the upper body and the thighs enclosing an angle of more than 90 degrees, resulting in a better sitting position, straightening of the spine and better health.

1 Claim, 6 Drawing Sheets

HEALTHY CHAIR

BACKGROUND OF THE INVENTION

1. Field of the Invention

The present invention relates to a healthy chair, particularly to a healthy chair which helps to attain a better sitting position, to straighten the spine and to relax.

2. Description of Related Art

The present inventor in fifteen years of experience of healing by massage has discovered a method for eliminating gluing together of muscle tissue or swollen ligaments by correcting the sitting position. In daily life, among standing, sitting and lying, sitting is the most unstable position of the human body. Therefore, a good sitting position helps to eliminate gluing together of muscle tissue or swollen ligaments.

In the human body, muscles and tissues are distributed and balanced around a central vertical line, being arranged in eight vertical sections: (1) above the cerical vertebrae, (2) above the shoulders, (3) above the ribs, (4) above the hip, (5) above the buttocks, (6) above the knees, (7) above the toes, and (8) below the toes. Thus the whole body gains softness and flexibility.

In complex daily life and with psychic changes, certain vertical sections of the human body lose balance and have to rely on other sections up to a point of becoming wound up and entangled, as viewed from a vertical perspective, so that diseases develop.

The human body has a three-dimensional structure with a surface that is held together by surface forces, with forces acting between diagonally opposed points, e.g., from the left half of the upper body to the right upper arm, the right lower arm and the left half of the belly to the right lower arm and the right hip, and from the right rear neck to the left forehead.

For balancing under gravitation, the upper body has five sections, with points of aplication of forces naturally arranged in a zig-zag pattern. FIG. 5A shows points of application of forces as circles and directions of forces as dashed lines, forming the zig-zag pattern. The larger angles between neighboring lines of forces become, the smaller are lever arms and, consequently, exerted torques.

Therefore, sitting in a position that comes close to a standing position has a strong influence on angles of lines of forces in the Z-shaped pattern and on the values of forces.

For the balance of the various parts of the human body, like neck, upper body, belly and hip, lumbar vertebrae are of decisive importance. In today's office work, sitting positions are usually characterized by a forward inclined upper body, with the belly staying in an original position, so that the lower arms are placed before the hip and even before the thighs, resulting in angles of lines of forces in the Z-shaped pattern that are larger than in a traditional upright sitting position. Furthermore, the angles between thigh and belly and the angles between calves and feet let forces at joints become smaller, while forces at the belly become larger, generating tension in the abdominal region.

Conventional chairs mostly have backrests for positioning the upper body. Thereby, angles of lines of forces in the Z-shaped pattern tend to be to small, resulting in too large torques, which possibly leads to gluing together of muscle tissue and swollen ligaments, even to failure of the nervous system.

SUMMARY OF THE INVENTION

It is an object of the present invention to provide a healthy chair which helps to improve the sitting position and to straighten the spine.

Another object of the present invention is to provide a healthy chair which improves health and slims the belly.

The present invention can be more fully understood by reference to the following description and accompanying drawings.

DETAILED DESCRIPTION OF THE PREFERRED EMBODIMENTS

The healthy chair of the present invention comprises: a seat plate 1, having an inclined orientation; several feet, mounted on a lower side of the seat plate 1; a frontal torso positioning device, extending away from the seat plate 1 in an upper-forward direction and having a far end in a fixed position; and a cross-member, mounted on rear ends of the feet. Sitting on the healthy chair of the present invention results in an upright position of the upper body brought about without voluntary action and prevents the upper body from being inclined too far. In particular, the foot support bars prevents the body from inclining forward and helps to relax feet and toes, so that an easing and healthy effect on the body is achieved.

Figure 2:
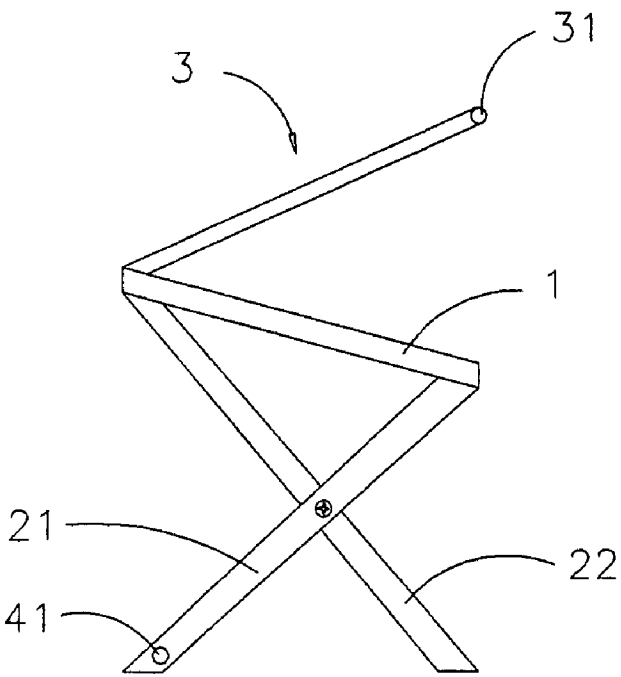
FIG. 2 is a side view of the healthy chair of the present invention in the first embodiment.
Figure 1:
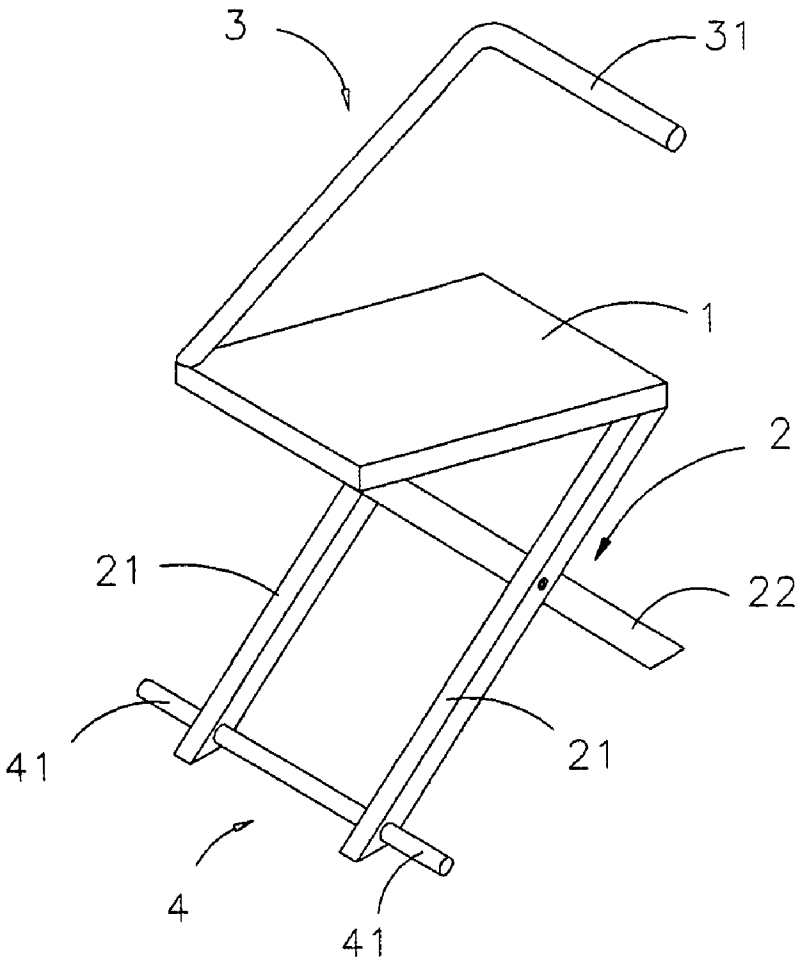
FIG. 1 is a perspective view of the healthy chair of the present invention in the first embodiment.

As shown in FIG. 1, in a first embodiment of the healthy chair of the present invention, on the lower side of the seat plate 1 a foot assembly 2 is mounted in an X-shaped pattern, consisting of a two feet 21 and two feet 22. The two feet 21 have lower ends reaching to a rear side and being connected by a cross-member bar 4. The cross-member bar 4 has two ends respectively extending beyond the two feet 21 forming ankle support bars 41. The seat plate 1 has a rear side from which an L-shaped positioning device 3 extends forward and upward, ending in a horizontal end 31.

Sitting on a regular chair has the thighs and the lower part of the upper body enclose an angle of 90 degrees or less, generating inner pressure inside the body. Sitting on the seat plate 1, however, results in the thighs being inclined downward, so that the thighs and the lower part of the upper body enclose an angle of more than 90 degrees, providing a relaxed feeling inside the body. As shown in FIGS. 5A, the healthy chair has no backrest. With the feet in addition placed behind the foot support bars, sitting at ease every day for half an hour not only helps to attain a better sitting position and straightening of the spine, but also better health for the body. Preferably the seat plate 1 has an inclination angle of 12–15 degrees, as shown in FIG. 4, with the frontal torso positioning device 3 leaning against the lower part of the upper body.

Figure 4:
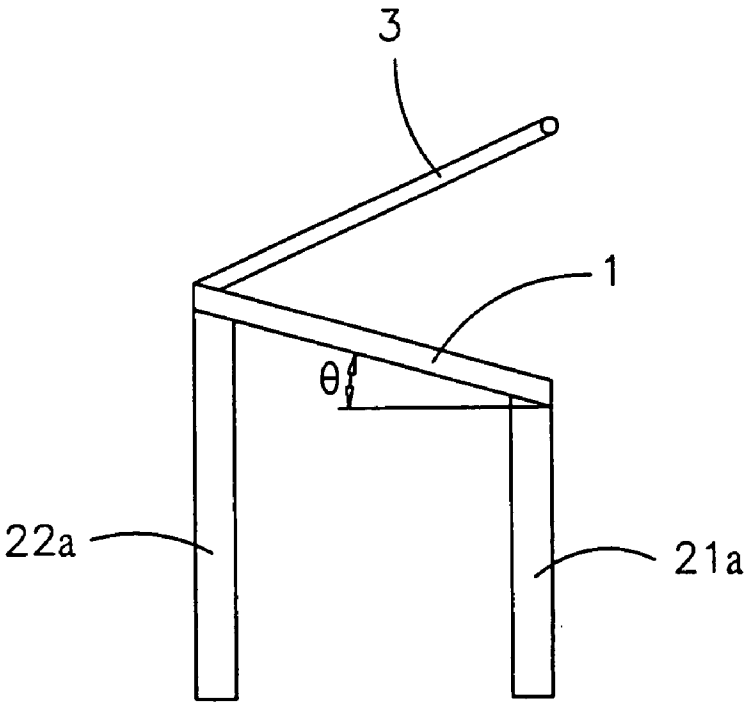
FIG. 4 is a side view of the healthy chair of the present invention in the second embodiment.
Figure 3:
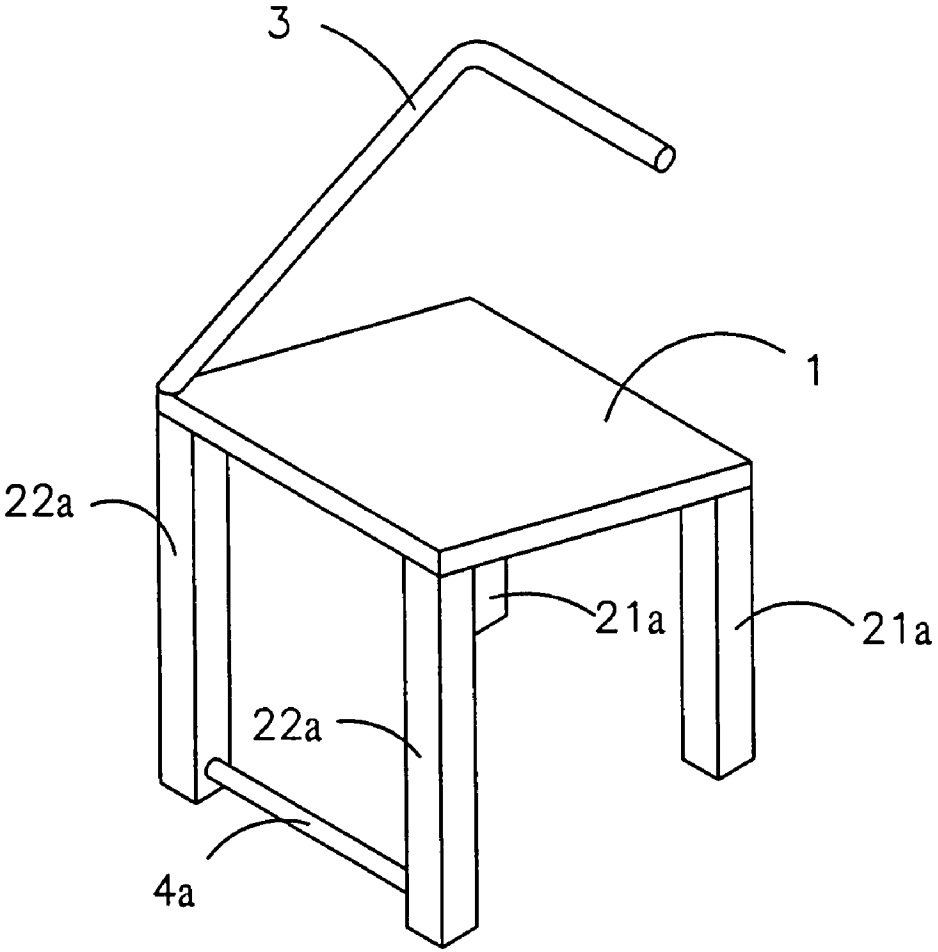
FIG. 3 is a perspective view of the healthy chair of the present invention in the second embodiment.
Figure 5A:
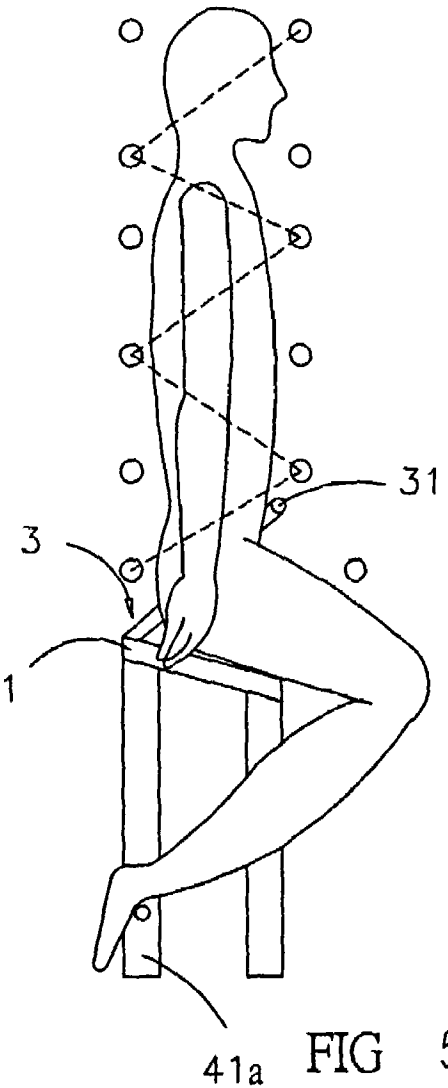
FIG. 5A is a schematic illustration of the use of the present invention.

Referring to FIGS. 3–4, the present invention in a second embodiment has two relatively short feet 21*a*, mounted on the seat plate 1 at a front side thereof, and two relatively long feet 22*a*, mounted on the seat plate 1 at a rear side thereof. The two relatively long feet 22*a* are connected by a cross-member.

Figure 5:
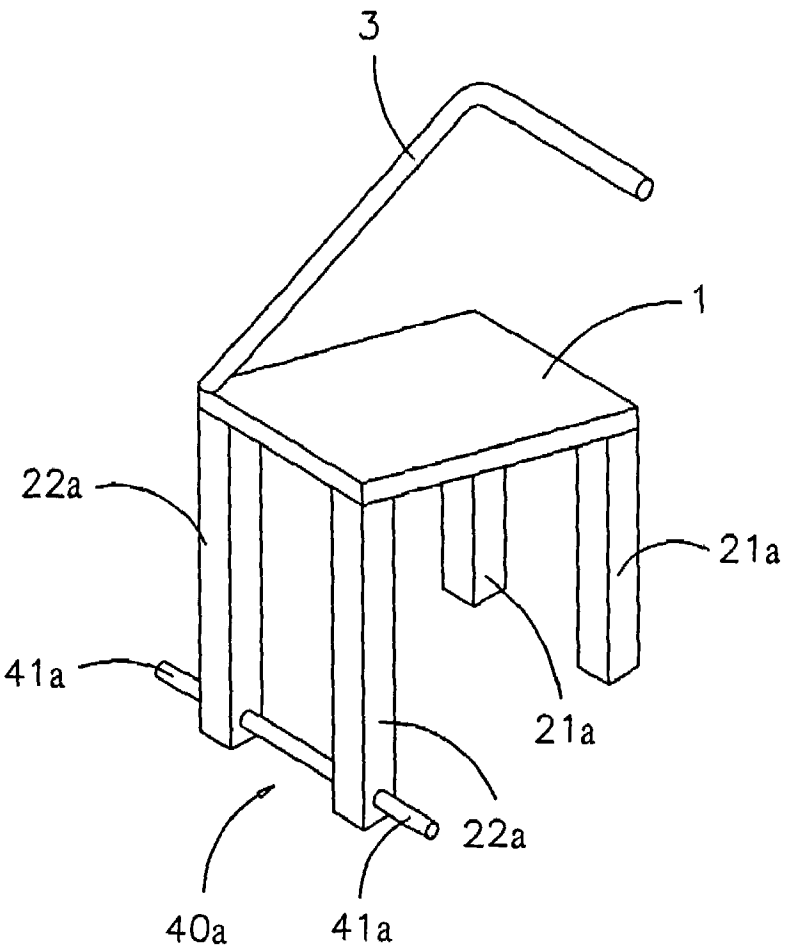
FIG. 5 is a perspective view of the healthy chair of the present invention in the third embodiment.

Referring to FIG. 5, the present invention in a third embodiment has a cross-member mounted between the two relatively long feet 22*a*, which extends beyond the two relatively long feet 22*a*, forming foot support bars 41*a*.

As shown in FIG. 5A, the healthy chair of the present invention, promotes the desired healty posture for a user, in which the upper body and the ground enclose an angle of about 85 degrees, with the thighs and the lower part of the upper body enclosing an angle of more than 90 degrees, the ankles resting behind the ankle support bars 41*a* so that the toes point approximately downward.

Figure 6:
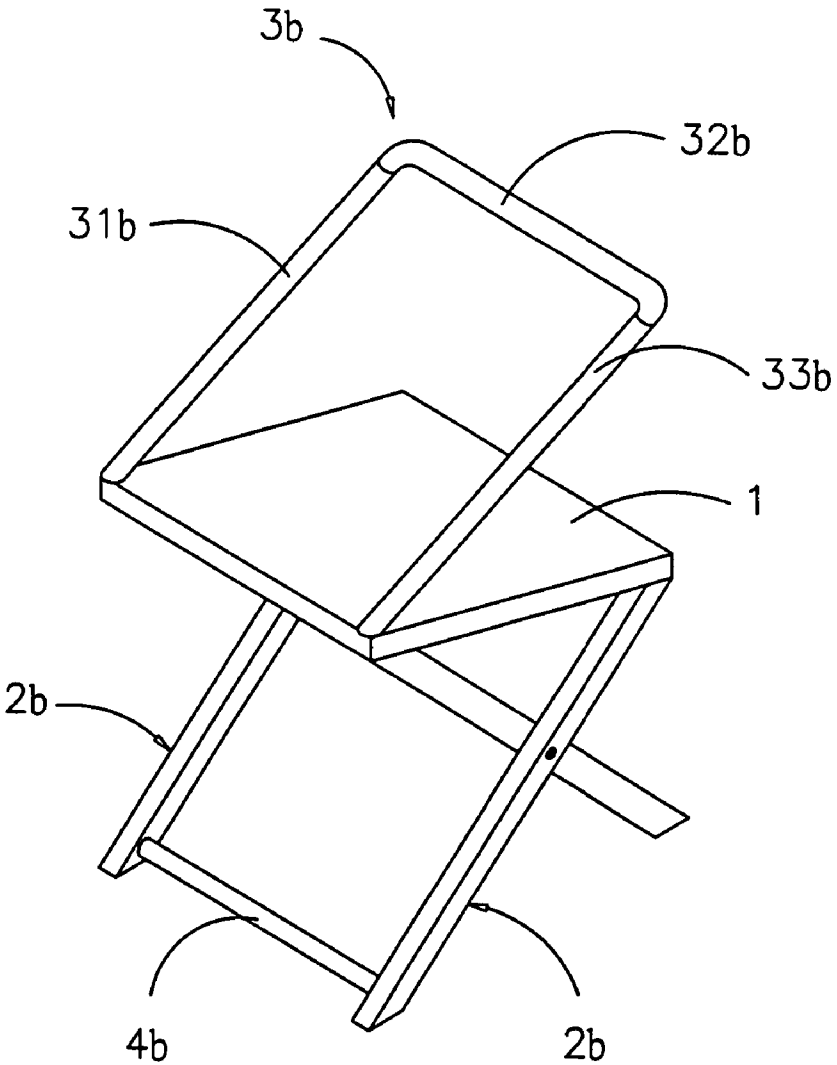
FIG. 6 is a perspective view of the healthy chair of the present invention in the fourth embodiment.

Referring now to FIG. 6, the present invention in a fourth embodiment has a foot assembly 2*b* in an X-shaped pattern mounted on the lower side of the seat plate 1 and having a relatively large width. A cross-member 4*b* is placed between rear lower ends of the foot assembly 2*b*. A frontal torso positioning device 3*b* is mounted on the seat plate 1, having a left extension bar 31*b*, a right extension bar 33*b* and a connecting rod 32*b* connecting the left and and right extension bars 31*b*, 33*b*. The connecting rod 32*b* has one hingedly attached end and one free end that can be fastened and released, or has two ends that can be fastened and released. This is conventional art and does not need to be explained further.

Figure 7:
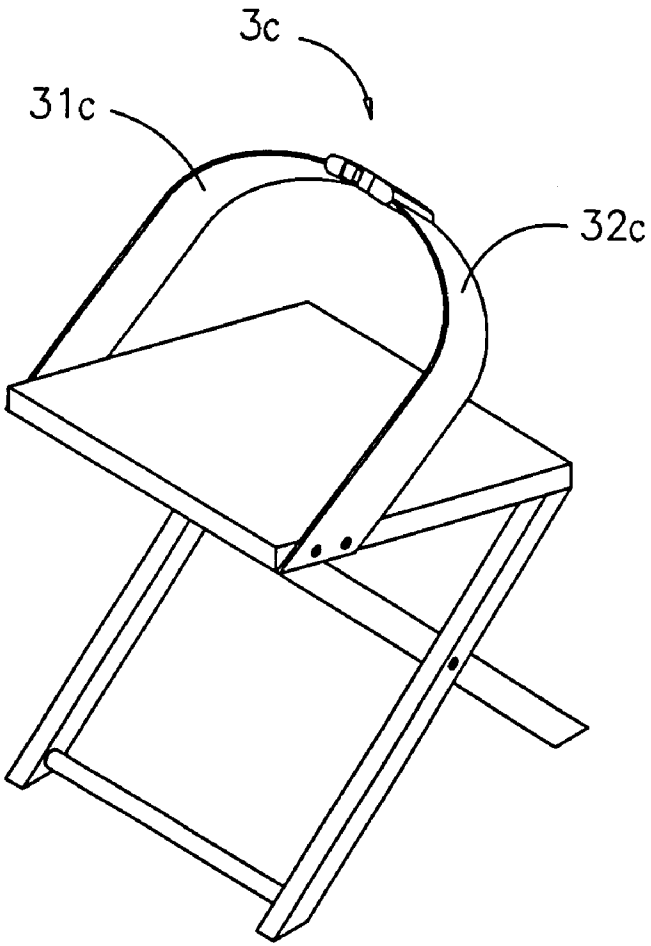
FIG. 7 is a perspective view of the healthy chair of the present invention in the fifth embodiment.
Figure 9:
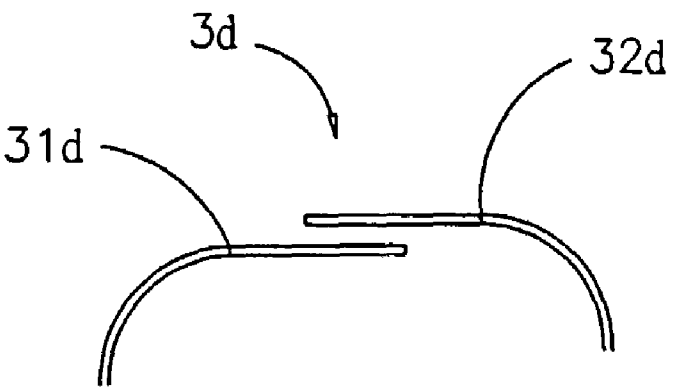
FIG. 9 is a schematic illustration of the belts of the present invention in the fifth embodiment provided with bur-like latches.
Figure 8:
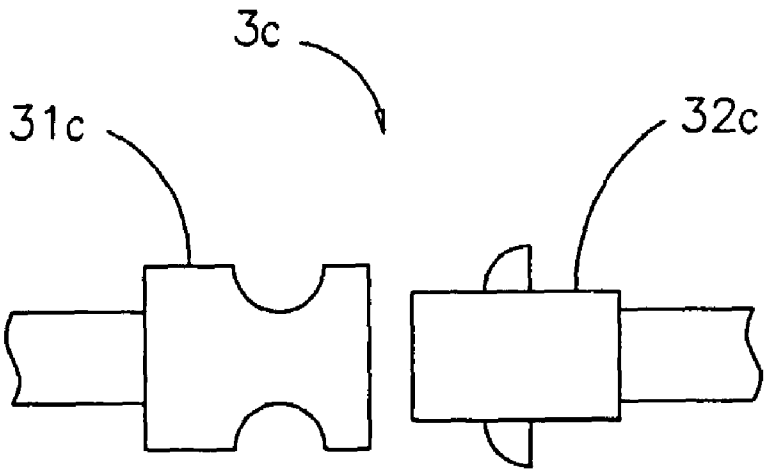
FIG. 8 is a schematic illustration of the buckle halves of the present invention in the fifth embodiment.
Figure 11:
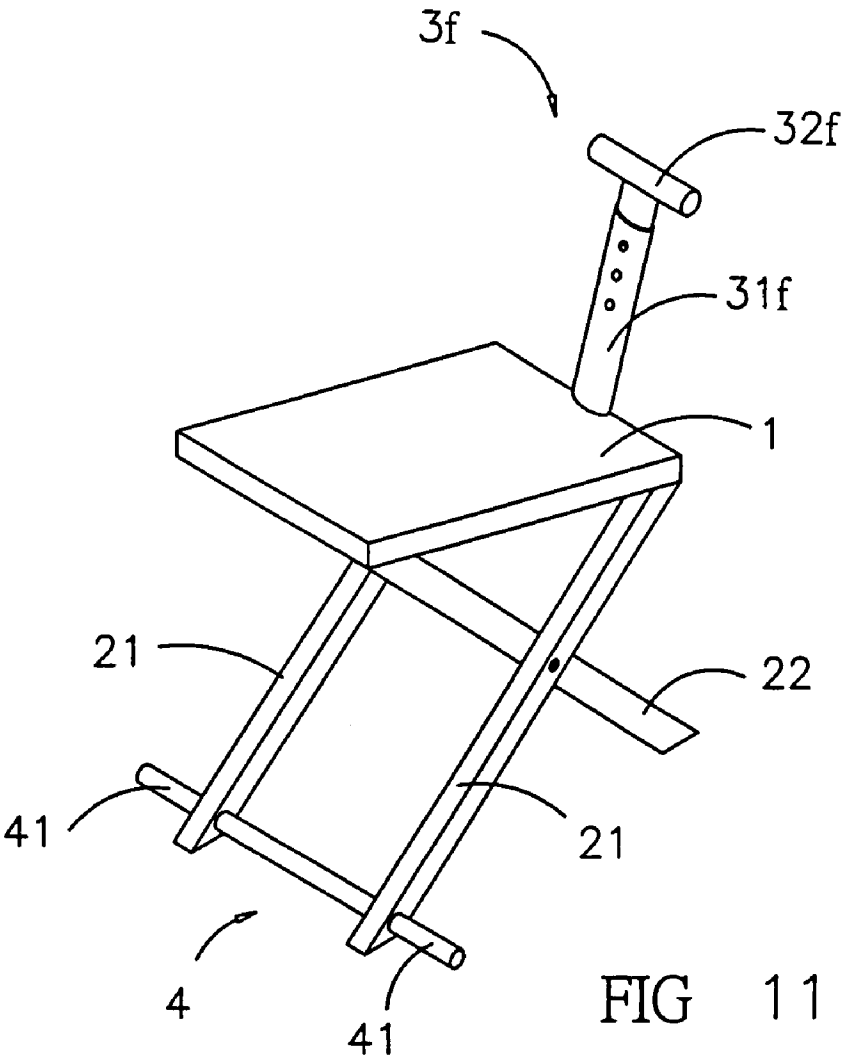
FIG. 11 is a perspective view of the healthy chair of the present invention in the seventh embodiment.

Referring to FIG. 7, the present invention in a fifth embodiment has a frontal torso positioning device 3*c* consisting of a belt 31*c* with a female buckle half and a belt 32*c* with a male buckle half, further shown in FIG. 8. Alternatively, as shown in FIG. 9, a frontal torso positioning device 3*d* with belts 31*d*,32*d* having bur-like latches is provided.

Figure 10:
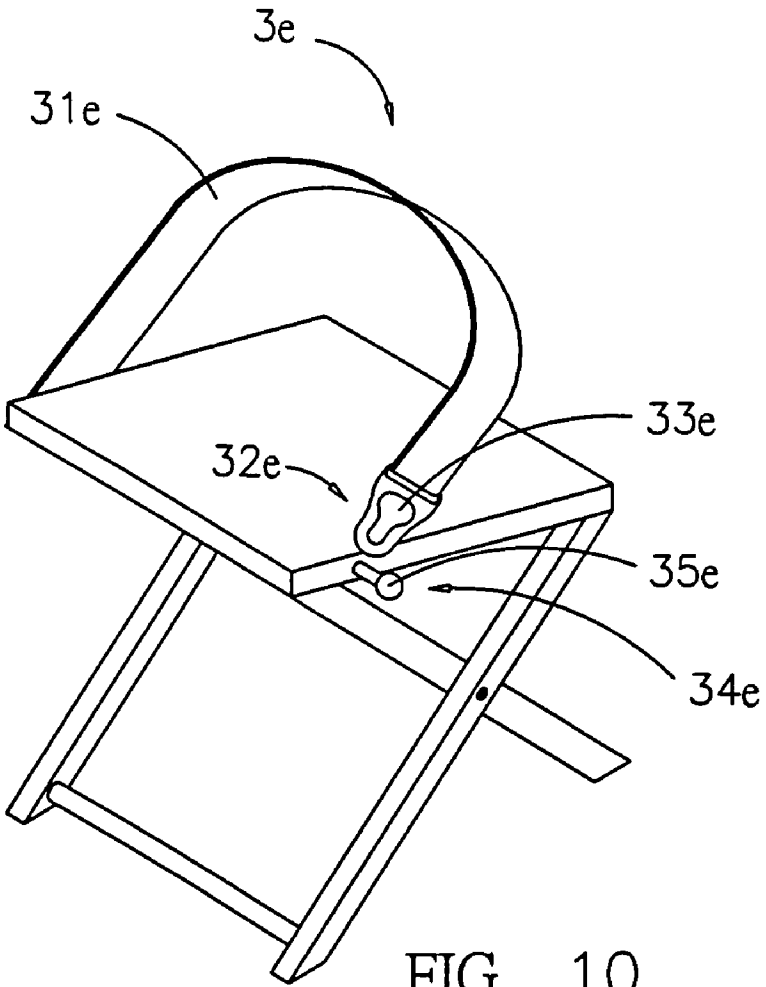
FIG. 10 is a perspective view of the healthy chair of the present invention in the sixth embodiment.

Referring to FIG. 10, the present invention in a sixth embodiment has a frontal torso positioning device 3*e* consisting of a belt 31*e* with a free end to which a fastening element 32 is attached. The fastening element 32*e* has a T-shaped opening 33*e*. A positioning element 34*a* is fixed on the seat plate 1, having a T-shaped pin 35*a* over which the fastening element 32*e* is put for fastening the frontal torso positioning device 3*e*.

Referring to FIG. 10, the present invention in a seventh embodiment has a frontal torso positioning device 3*f* consisting of a vertical part 31*f* mounted on said front side of said seat plate and a horizontal extension piece 32*f* set on said vertical tube 31*f* on an upper end thereof.

While the invention has been described with reference to preferred embodiments thereof, it is to be understood that modifications or variations may be easily made without departing from the spirit of this invention which is defined by the appended claims.

The invention claimed is:

1. A healthy chair comprising:

a seat plate inclined downward from a rear side towards a front side at a fixed angle between about 12 to about 15 degrees from horizontal, and having a lower side surface;

a plurality of feet, fixedly mounted on said lower side surface of said seat plate, supporting said seat plate;

at least two ankle support rods each attached to at least one of said plurality of feet, said ankle support rods projecting laterally outward in opposing directions below said rear side of said lower surface of said seat plate, positioned to allow a user of said healthy chair to hook their ankles behind said support rods with the toes pointed downward; and a frontal torso positioning device, having a fixed end fastened to said seat plate and a free end extending forward and upward from said seat plate at a fixed position, wherein said frontal torso positioning device has a shape like the letter L; and whereby said seat plate, said ankle support rods, and said frontal torso positioning device cooperate in producing a desired healthy posture for a user of said healthy chair.

* * * * *